US006588847B2

(12) United States Patent
Murakami

(10) Patent No.: US 6,588,847 B2
(45) Date of Patent: Jul. 8, 2003

(54) CHAIR

(75) Inventor: Tomokazu Murakami, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 0 days.

(21) Appl. No.: 09/869,958

(22) PCT Filed: Dec. 1, 2000

(86) PCT No.: PCT/JP00/08552

§ 371 (c)(1),
(2), (4) Date: Jul. 10, 2001

(87) PCT Pub. No.: WO01/39633

PCT Pub. Date: Jun. 7, 2001

(65) Prior Publication Data

US 2002/0158501 A1 Oct. 31, 2002

(30) Foreign Application Priority Data

Dec. 4, 1999 (JP) ..... 11/376269

(51) Int. Cl.[7] ..... A47C 7/54
(52) U.S. Cl. ..... 297/411.37; 297/411.31
(58) Field of Search ..... 297/411.35, 411.37, 297/411.38, 411.2, 411.31, 411.3

(56) References Cited

U.S. PATENT DOCUMENTS 5,275,465 A 1/1994 Gulliver et al.
5,380,065 A * 1/1995 Rohrer ..... 297/411.37
5,651,586 A * 7/1997 Groth ..... 297/411.37
5,752,683 A * 5/1998 Novis et al. ..... 297/411.36 X
5,884,976 A * 3/1999 Breen et al. ..... 297/411.37
5,975,640 A * 11/1999 Chen ..... 297/411.37
6,086,156 A * 7/2000 Breen et al. ..... 297/411.37

FOREIGN PATENT DOCUMENTS

| | | |
|---|---|---|
| JP | 58-44247 | 3/1983 |
| JP | 4-51254 | 1/1992 |
| JP | 5-11862 | 2/1993 |
| JP | 6-22828 A | 2/1994 |
| JP | 6-50542 | 7/1994 |
| JP | 10-166919 A | 6/1998 |
| JP | 3056914 U | 12/1998 |

* cited by examiner

*Primary Examiner*—Peter M. Cuomo
*Assistant Examiner*—Stephen Vu
(74) *Attorney, Agent, or Firm*—Banner & Witcoff, Ltd.

(57) ABSTRACT

A chair has a chair body and armrests installed on the sides of the chair body. The armrests include arm supports and arm mounts, with the arm supports being attached to the sides of the chair body and the arm mounts being supported by the arm supports. Linking elements, or other suitable elements, are provided between the chair body and the arm supports or in part of the armrest for controlling at least the arm mounts so that they can move in a substantially regular path around a person in the chair, between a first use position, wherein the length direction of the arm mounts is nearly in the longitudinal direction of the chair body; and a second use position wherein the length direction of the arm mounts is nearly in the lateral direction of the chair body.

18 Claims, 3 Drawing Sheets

CHAIR

FIELD OF THE ART

The present invention relates to a chair with movable armrests that are comfortable and easy to use.

BACKGROUND ART

In recent years, desktop OA (office automation) equipment, such as personal computers, has been used more frequently in offices and the like. As chairs become more functional, reclining against the back of a chair has been found to be the most comfortable position for operating a personal-computer keyboard or the like. Because a person in a chair tends to work at a desk with his or her arms stretched forward, it is preferable that the person use part of the desktop as an armrest to reduce the load on the arms. However, if the person cannot place the arms on the desktop because he or she is in a reclined position, the desktop is not sufficiently wide, or the person cannot get close enough to the desktop due to occupied space under the desk, the person cannot use the desktop as an armrest. Particularly when operating a keyboard, a person in a chair tends to hold his or her arms closer together than the distance between his or her shoulders. Thus, armrests that can be placed in front of the person are needed.

Chairs have been proposed with armrests that can be moved from their original position to in front of a person in the chairs when he or she operates a personal computer. Such chairs include those with armrests consisting of arm supports attached to the sides of the chair body, and arm mounts, each of which are rotatably attached to an arm support using one shaft, and those that are designed to rotatably connect an arm support to a connecting member using one shaft, and an arm mount to the connecting member also using one shaft, with the connecting member interposed between the arm support and arm mount.

However, because a chair that is adapted to turn an arm mount using one shaft is unstable and weak, the shaft is likely to be damaged if a load is exerted at a point too far from the shaft. In addition, the range of rotation of the arm mount around the shaft is limited, so that the arm mount cannot be moved far in front of a person in the chair.

A chair is available that has an arm mount that turns around two shafts at both ends of one free-end link connecting an arm support and the arm mount together. Although such an arrangement allows the arm mount to move more widely, it poses the following problem: part of the arm mount protrudes so far outward during its rotation from the side of a person in the chair to his or her front, that he or she must move the chair back or assume an uncomfortable position to prevent the mount from interfering with the desktop and him or herself In addition, the arm mount may be damaged if a load is applied to the mount when it is protruding far outward. If the distance between the two shafts is decreased to solve these problems, the movement of the arm mount is limited to a narrow range, thus preventing the arm mount from being fully moved from its regular position to in front of the person in the chair. As is obvious from the above, conventional armrests are uncomfortable and difficult to use.

DISCLOSURE OF THE INVENTION

In view of the foregoing, the present invention is directed to a chair with armrests that can be used as necessary by controlling the arm mounts so that they follow the figure of the person in the chair.

A chair according to the present invention includes a chair body with armrests attached to its sides. The armrests include arm supports and arm mounts. The arm supports are attached to the sides of the chair body and support the arm mounts. A controlling means for controlling at least the arm mounts so that they can move around a person in the chair in a regular path between a first use position on the sides of the person sitting on the chair body and a second use position in front of the person, is provided between the chair body and the arm supports or in part of the armrests.

Such an arrangement allows at least the arm mounts to move around the person in a chair between the first use position on the sides of the person and the second position in front of the person. Thus, the person in the chair places his or her arms on the arm mounts in the first use position when he or she is performing no operation at his or her desk, and the person can move the arm mounts to the second use position and effectively use them as armrests when he or she performs an operation at his or her desk, such as using a personal computer. Because the arm mounts follow a substantially regular path under the control of the controlling means when moving to the second use position, it is not necessary for the person in the chair to avoid the arm mounts. Moreover, the arm mounts make only necessary motions, without protruding too far forward or to the side, thus increasing armrest stability.

In particular, to appropriately move only the arm mounts with the mounts stably supported by the arm supports, it is desirable that, using an arm supporting means, the arm supports support the arm mounts so that the arm mounts can move between the first and second use positions and the controlling means can control the movement of the arm mounts through the use of the supporting means.

A preferable method of properly moving an arm mount is to use a link mechanism as a supporting means and controlling means by connecting the arm mount through the link mechanism to an arm support. To make the link mechanism extremely simple, it is desirable that it constitute first and second link elements that are rotatably attached to the connections between the arm support and the arm mount, that at least the first link element be used as the supporting means, and that the first and second link elements constitute the controlling means.

To appropriately rotate an arm mount using such a link mechanism, it is preferable that the tetragon formed by the straight lines connecting attachment holes in the first and second link elements not be a parallelogram. To allow the arm mount to follow an appropriate path, a preferable link mechanism should meet the following requirements: the first link element rotates a hole for attachment to the arm mount from an obliquely rear outside position to an inside position, With a hole for attachment to the arm support at the center of rotation; the second link element rotates the hole for attachment to the arm mount from an obliquely rear outside position to an obliquely front outside position, with the hole for attachment to the arm support at the center of rotation; and the straight line connecting the hole for attaching the first link element to the arm mount and the hole for attaching the second link element to the arm mount rotates between the first and second use positions, from the position at which the line is nearly in the longitudinal direction of the arm mount to the position at which the line is nearly in the lateral direction of the arm mount.

To effectively limit the range of rotation of the first and second link elements through the use of the link mechanism, the first and second link elements are adapted so as to interfere with each other at or near the first and second use positions.

To improve arm mount support strength and maintain a regular arm mount path, it is preferable that the second link element, together with the first link element, supports the arm mounts, and that the link mechanism uniquely determines the arm mount path.

Another link mechanism that allows the arm mounts to move in a substantially regular path, while allowing slight deviation from the path is adapted so that the distance between the attachment holes in the second link element changes due to deformation of an elastic body forming the second link element, such as a spring, when the arm mounts move from the first use position to the second use position.

Still another link mechanism that allows the entire armrests, that is, the arm mounts and arm supports, to move in a substantially regular path around a person in a chair between the first and second use positions is provided with a controlling means that rotates the arm supports, together with the arm mounts, between the chair body and arm supports around the person. To allow the armrests to move smoothly without interfering with the person, the arm supports are preferably curved or bent to prevent them from interfering with the person when he or she moves between the first and second use positions.

To ensure that the arm mounts serve as armrests when a person in a chair such as that described above operates a personal computer, it is preferable that a pair of armrests be disposed on both sides of the chair body, and that the ends of the arm mounts butt against each other when the pair of arm mounts is placed in the second use position.

As described above, a chair according to the present invention has armrests on the sides of the chair body. Using controlling means provided in the armrests or between the chair body and arm supports, the armrests, that is, the arm mounts supported by the arm supports attached to the sides of the chair body, are controlled so that at least the arm mounts move around the person in the chair in a substantially regular path between the first use position on the sides of the person and the second use position in front of the person. Thus, when he or she is not at his or her desk, the person in the chair can place his or her arms on the arm mounts in the first use position to assume a comfortable position. In addition, when he or she performs an operation, such as using a personal computer, at his or her desk, the person in the chair can stretch his or her arms forward on the arm mounts in the second use position nearly in front of him or her, to effectively use the arm mounts as armrests. The person in the chair can make the space between the arms wider or narrower than the width of his or her shoulders to place his or her arms on the arm mounts in the second use position, so that he or she can work more freely. Under the control of the controlling means, at least the arm mounts move in a substantially regular path through an angle of approximately 90° or slightly greater from the first use position to the second use position. Thus, the arm mounts make only necessary movements, without protruding significantly outward or inward, enabling the person in the chair to move the armrests smoothly and stably without moving the chair back or avoiding the arm mounts, even if there is little space between the chair or person and the desk or the like.

Such a chair arrangement makes the arm mounts more stable with respect to the arm supports and allows only the arm mounts to be moved appropriately if the arm supports are used to support the arm mounts between the first and second use position, so that the mounts can move with respect to the arm supports and movement of the arm mounts can be controlled using the controlling means.

If the arm mounts are connected through the link mechanism, which serves as a supporting and controlling means, to the arm supports, the arm mounts can be effectively supported and moved in an appropriate path. Particularly if the link mechanism consists of the first and second link elements, which are rotatably attached to the connections of the arm supports and arm mounts, and the controlling means consists of the first and second link elements, with at least the first link element being used as the supporting means, the link mechanism can be provided with a simple structure. Moreover, if the tetragon formed by the straight lines connecting the four attachment holes in the first and second link elements is not a parallelogram, a link mechanism consisting of the two link elements can be used to smoothly move the arm mounts around the person in the chair when two of the four sides of the tetragon are secured.

Specifically, a simple link mechanism that moves the arm mounts in a substantially regular path around the person in the chair can be provided if arrangements are made to meet the following requirements: the first link element is adapted to rotate its holes for attachment to the arm mounts from an obliquely rear outside position to an inside position, with its holes for attachment to the arm supports at the center of rotation; the second link element is adapted to rotate its holes for attachment to the arm mounts from an obliquely rear outside position to an obliquely front outside position, with its holes for attachment to the arm supports at the center of rotation; and a straight line connecting the hole for attaching the first link element to the arm mount with the hole for attaching the second link element to the arm mount rotates between the first and second use positions, from the position at which the line is nearly in the longitudinal direction of the arm mount and to the position at which the line is nearly in the lateral direction of the arm mount.

If the first and second link elements are adapted so as to interfere with each other at or near the first and second use positions, the link mechanism can effectively be used to limit the range of rotation of the link elements.

If the second link element is adapted so as to support the arm mounts like the first link element, and these two link elements are used to uniquely determine the arm-mount path, the arm mount support strength can effectively be increased, and the arm mounts can be moved in a regular path.

If the second link element is formed using an elastic body such as a spring and the distance between the attachment holes in the second link element is changed by deforming the elastic body when the arm mounts move from the first use position to the second use position, the movement path of the arm mount can be varied slightly with the path kept substantially regular, and the arm mounts can be adapted so as to be at the first and second use positions. Thus, the arm mounts can easily be moved regardless of the physical build and position of the person in the chair.

In addition, if a controlling means is provided between the chair body and arm supports to turn the arm supports together with the arm mounts, the armrests can be moved in a substantially regular path between the first and second use positions, thus allowing the arm mounts to be used effectively as armrests. Particularly in such a case, curving or bending the arm supports so that they do not interfere with the person in the chair during arm mount movement allows the arm mounts to move smoothly.

In the above-described arrangements, if a pair of armrests is disposed on the sides of the chair so that the ends of the arm mounts butt against each other when both arm mounts are at the second use position, no gap forms between the arm mounts at the second use position, thus allowing the arm mounts to be used as reliable armrests when the person in the chair works on a personal computer with his or her arms stretched forward.

BEST MODES OF EMBODYING THE INVENTION

Figure 1:
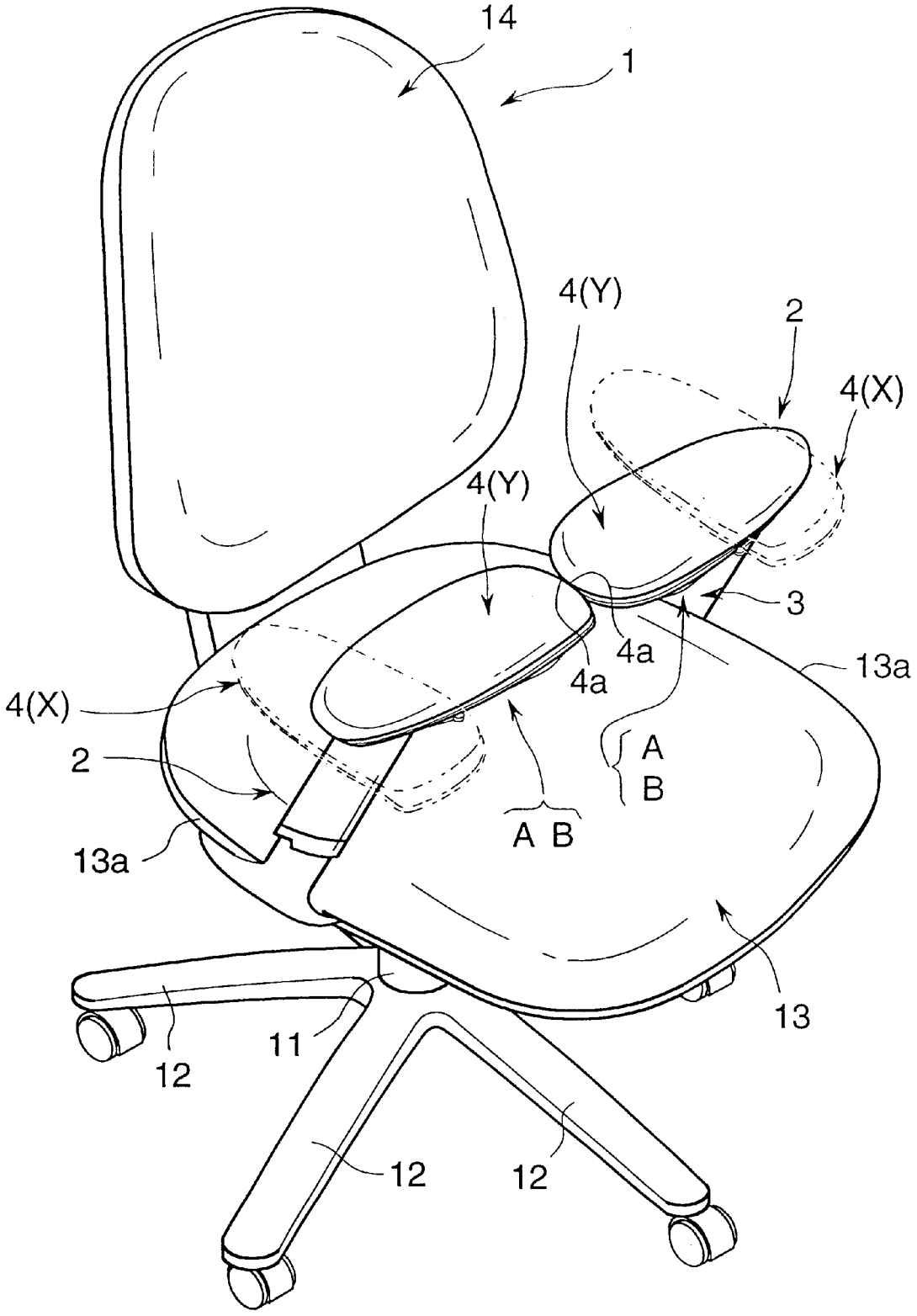
FIG. 1 is a general perspective view of an embodiment of the present invention.

Referring to the drawings, an embodiment of the present invention is described below.

As shown in FIG. 1, a chair according to an embodiment is a chair body 1 with a pair of armrests 2 attached to each side of the chair body. The chair body 1 is structured by positioning a seat. 13 on top of a support 11 at the center of a leg assembly 12, and installing a back 14 at the back of the seat 13. The chair body is adapted so that the back 14 can rock through the use of an appropriate mechanism. The armrests 2 are attached so as to protrude downward from the bottom of the seat 13.

Figure 2:
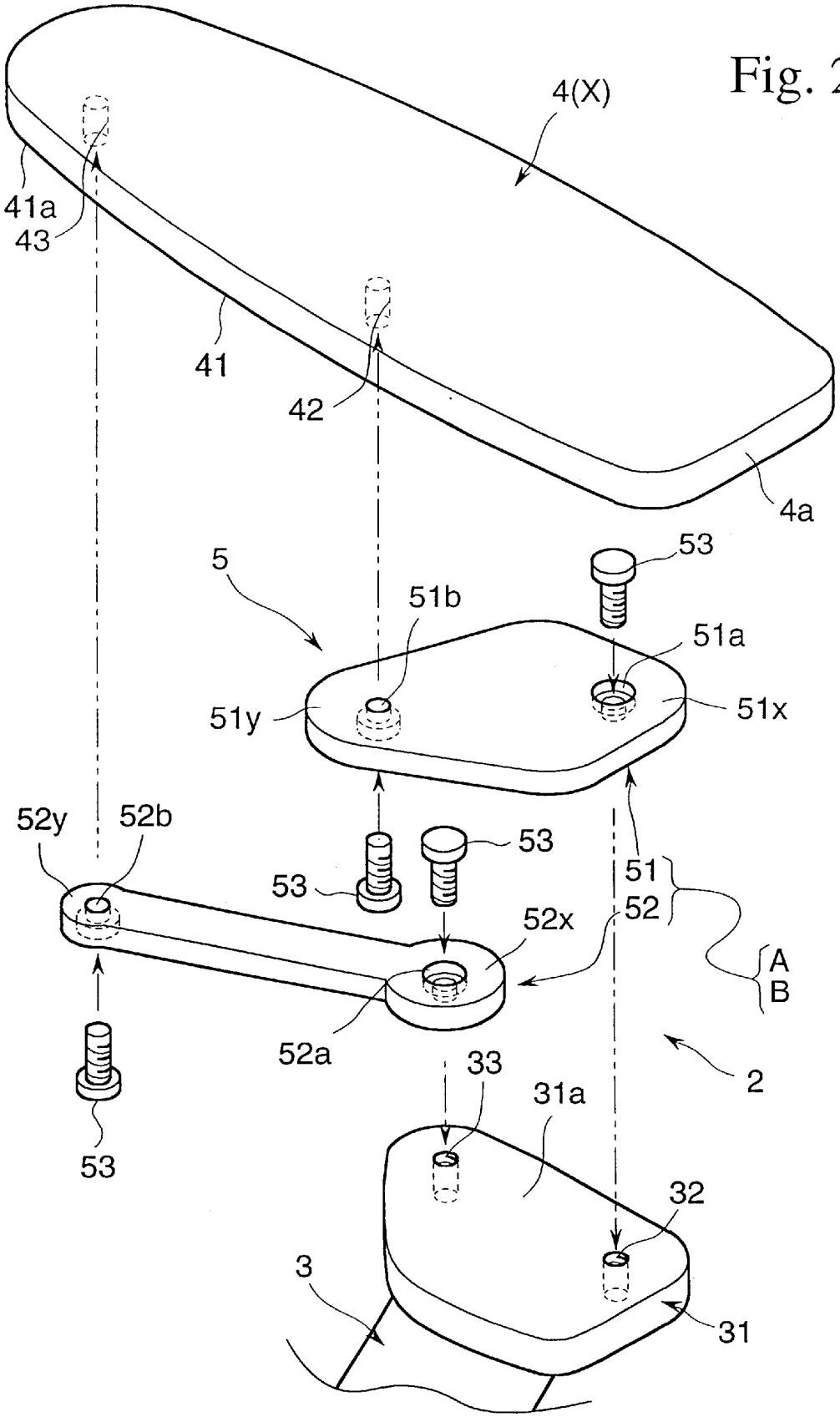
FIG. 2 is an enlarged exploded perspective view of the right armrest in the embodiment.
Figure 3:
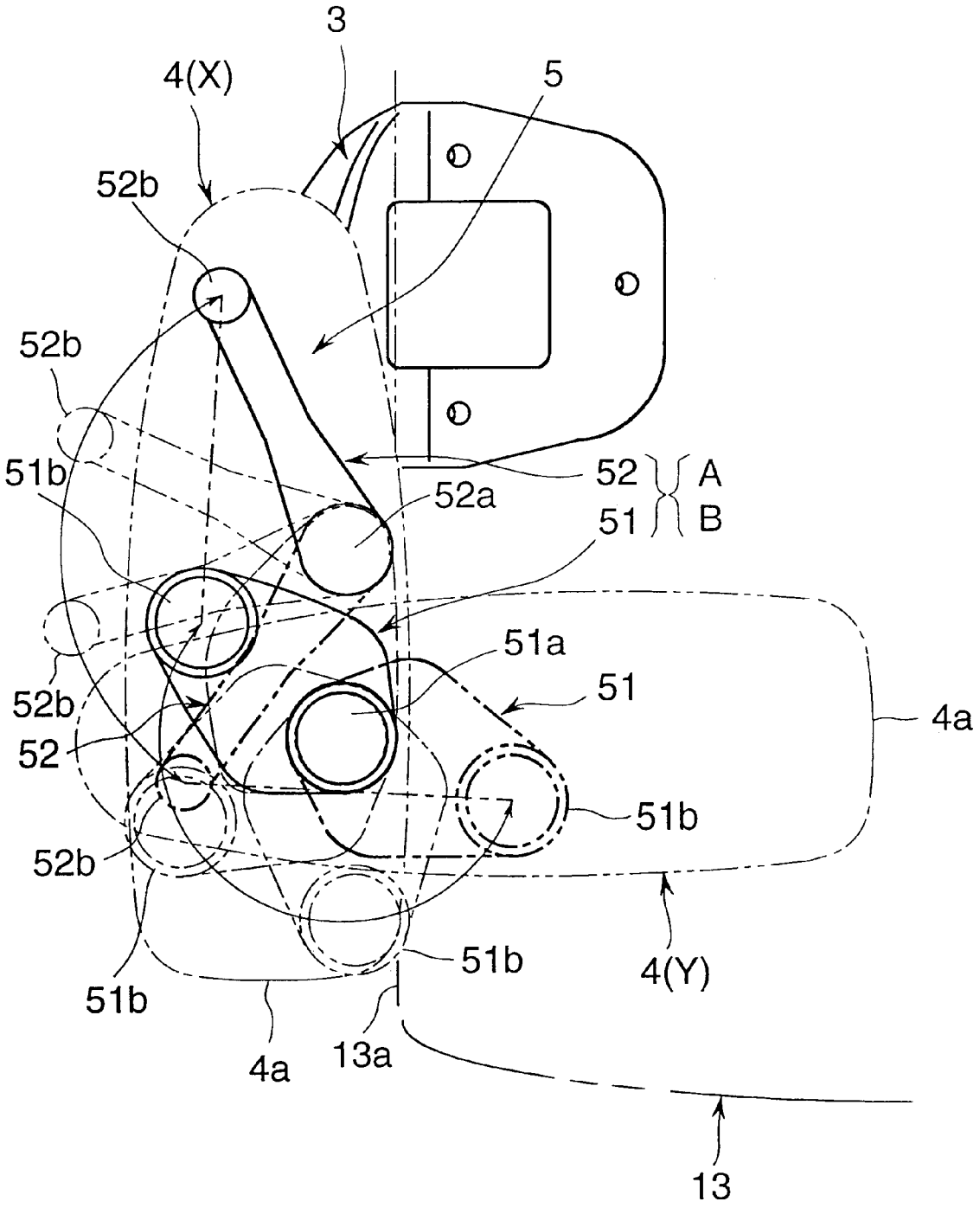
FIG. 3 illustrates the motions of the right armrest.

As shown in FIGS. 1 through 3, the armrests 2 include arm mounts 4 that are movably attached through link mechanisms 5 to the upper end of arm supports 3 attached to the bottom of the seat 13. The arm supports 3 have, on their upper ends, a pedestal 31 that is substantially trapezoidal as viewed from above.

The arm mounts 4 completely cover the top of the pedestal 31 when they are placed in such a first use position X that their length direction is nearly in the lateral direction of the seat. The arm mounts, which are board-shaped, are supported by pedestals 31 when they overhang forward, backward, and sideward. Pads made of a cushioned material are attached to the arm mounts 4 so that the pads cover the top of the mounts. Here, the pads are not shown or described.

As shown in FIGS. 2 and 3, a link mechanism 5 includes a first link element:51 and a second link element 52. The first link element 51, which has a predetermined thickness and is substantially rhombic as viewed from above, is disposed between the pedestal 31 and the bottom 41 of the arm mount 4. The first link element has a first attachment hole 51*a* that is located in a corner 51*x* on the longer diagonal, is a boss hole, and opens upward, and a second attachment hole 51*b* in the diagonally opposite corner 51*y* that is also a boss hole and opens downward. If a bolt 53 is inserted, the first attachment hole 51*a* can be rotatably combined with a threaded hole 32 at the front inside corner on top 31*a* of the pedestal 31. If another bolt 53 is inserted, the second attachment hole 51*b* can be rotatably combined with a threaded hole 42 provided near the center, but slightly in the longitudinal direction of the arm mount 4 on its bottom 41.

The second link element 52, which is almost as thick as the first link element 51 and is rod-shaped, has a third attachment hole 52*a* that is a boss hole and opens upward at one end 52*x*, and a fourth attachment hole 52*b* that is also a boss hole and opens downward at the other end 52*y*. If a bolt 53 is inserted, the third attachment hole 52*a* can be rotatably combined with a threaded hole 33 in a rear inside corner on top 31*a* of the pedestal 31. If another bolt 53 is inserted, the fourth attachment hole 52*b* can be rotatably combined with a threaded hole 43 provided at the rear edge facing away from the arm mount 4. The first and second link elements 51 and 52 together constitute supporting means A for supporting the arm mount 4 and controlling means B for controlling the arm mount, so that it moves in a regular path around a person in the chair. The attachment holes S la, 52*b*, 52*a*, and 52*b* are disposed so that the tetragon formed by the straight lines connecting these attachment holes is not a parallelogram.

The link mechanism 5 causes the arm mount 4 to move in a regular path around a person in the chair between the first use position X on a side of the seat 13 and the second use position Y at the upper front of the seat 13. For the right arm mount, operation of the link mechanism 5 is specifically described below. As shown in FIG. 3, when the right arm mount 4 is moved forward from the first use position X by hand, the first link element 51 rotates the second attachment hole 51*b* counterclockwise as viewed from above, with the first attachment hole 51*a* at the center of rotation so as to move the second attachment hole 51*b* in an arc from an obliquely rear outside position to an inside position above the seat 13. The second link element 52 rotates the fourth attachment hole 52*b* counterclockwise as viewed from above, with the third attachment hole 52*a* at the center of rotation so as to move the fourth attachment hole 52*b*, in an arc, along a side 13*a* of the seat 13 from an obliquely rear outside position to an obliquely front outside position. Here, a straight line connecting the second attachment hole 51*b* in the first link element 51 to the fourth attachment hole 52*b* in the second link element 52 (the straight line is represented by a chain line in the figure) rotates from the position at which the straight line is nearly in the longitudinal direction of the arm mount, which corresponds to the first use position X, to the position at which the straight line is nearly in the lateral direction of the arm mount, which corresponds to the second use position Y. As a result, the movement path of the right arm mount 4 is determined uniquely so that it moves from the first use position X to the second use position Y in a regular path around the person in the chair. As with the right arm mount, the left arm mount 4 also moves in a regular path around the person in the chair.

When the right and left arm mounts 4 move to the second use position Y, their ends 4*a*, facing inward, butt against each other, thus stopping the arm mounts 4. When one of the right and left arm mounts 4 moves to the second use position Y, that arm mount 4 stops in a position nearer to the person in the chair than the second use position Y. That is, in the position nearer to the person in the chair than the second use position Y, the first and second link elements 51 and 52 are made to interfere with each other so as to limit the range of rotation of both link elements 51 and 52. The first and second link elements 51 and 52 are also made to interfere with each other near the first use position X so as to limit the range of rotation of both link elements.

A chair according to this embodiment; arranged as described above, has a pair of armrests 2 attached to the sides of the chair body 1, with each armrest consisting of the arm support 3 and the arm mount 4 supported by the arm support. Using the controlling means B provided in the armrests 2, the arm mounts 4 are controlled so as to move in a regular path around the person in the chair between the first use position X on each side of the person and the second use position Y substantially in front of the person. Thus, the person in the chair places his or her arms on the arm mounts 4 in the first use position X to assume a comfortable position. Alternatively, when performing an operation at his or her desk, such as using a personal computer, the person stretches his or her arms forward on the arm mounts 4 in the second use position Y to use the mounts as armrests. As described above, the person in the chair can use the arm mounts 4 conveniently. When using the arm mounts 4 in the second use position Y, the person in the chair can make the space between the arms wider or narrower than the width of his or her shoulders to enable an operation, such as using a personal computer, to be performed more freely. Moreover, the person in the chair can place his or her arms on the arm mounts 4 to allow them to relax. Under the control of the controlling means B, the arm mounts 4 move in a substantially regular path through an angle of approximately 90° or slightly greater between the first and second use positions. Thus, the arm mounts 4 make necessary movements only, without significantly protruding outward or inward, enabling the person in the chair to easily and stably move the arm mounts 4 without moving the chair back or avoiding the arm mounts.

Particularly in this embodiment, the link mechanisms 5 constituting the supporting means A support the arm mounts 4 so that they can move with respect to the arm support 3 between the first and second use positions. In addition, the link mechanisms 5 constitute the controlling means B for controlling the movement of the arm mounts 4. These arrangements increase the stability of the arm mounts 4 relative to the arm support 3, and allow only the arm mounts 4 to be moved appropriately. That is, because the arm mounts 4 are connected to the arm supports 3 through the link mechanisms 5, which serve as both the supporting means A and controlling means B, the arm mounts 4 can be securely supported using a reduced number of parts, and can easily be moved in an appropriate path.

The link mechanisms 5 consist of the first and second link elements 51 and 52 rotatably attached to the connections between the arm supports 3 and the arm mounts 4. The link elements 51 and 52 are used as the supporting means A and controlling means B, thus allowing the link mechanisms 5 to be simplified and the arm mounts 4 to be made more stable. In addition, because the tetragon formed by the straight lines connecting the attachment holes 51*a*, 51*b*, 52*a*, and 52*b* in the first and second link elements is not a parallelogram, a so-called non-parallel link mechanism with two sides secured allows the arm mounts 4 to be smoothly around the person in the chair.

Specifically, the link mechanisms 5 cause the first link element 51 to rotate the second attachment hole 51*b* for attaching the arm support 31 to the arm mount 4 from an obliquely rear outside position to an inside position, with the first attachment hole 51*a* for attaching the arm support 3 to the pedestal 31 at the center of rotation. The link mechanisms also cause the second link element 52 to rotate the fourth attachment hole 52*b* for attaching the arm support 3 in the arm mount 4 from an obliquely rear outside position to an obliquely front outside position, with the third attachment hole 52*a* for attaching the arm support 3 to the pedestal 31 at the center of rotation. Thus, a straight line connecting the second attachment hole 51*b* in the first link element 51 to the fourth attachment hole 52*b* in the second link element 52 rotates between the first use position X and the second use position Y from the position at which the straight line is nearly in the longitudinal direction of the arm mount to the position at which the straight line is nearly in the lateral direction of the arm mount. These arrangements allow the arm mounts 4 to move around the person in the chair.

Because the first and second link elements 51 and 52 are adapted so as to interfere with each other near the first and second use positions X and Y, the link mechanisms 5 can easily and effectively limit the range of rotation of the link elements 51 and 52 without providing additional means for limiting the range of rotation of the link elements 51 and 52.

In addition, as described above, the first link element 51 and the second link element 52, which is adapted so as to support the arm mounts 4 together with the first link element 51, are used to uniquely determine the path of the arm mounts 4. Thus, not only can the support strength of the arm mounts 4 be effectively increased, but the arm mounts 4 can be prevented from deviating from a regular path when they move.

When the pair of arm mounts 4 is placed at the second use position Y, the ends 4*a* of the arm mounts 4 butt against each other, with the length direction of the arm mounts 4 nearly in the lateral direction of the seat. Thus, there is no gap between the arm mounts 4 at the second use position Y, enabling the arm mounts 4 to be used as stable, reliable armrests.

The present invention is not limited to this embodiment. For example, a spring or an elastic body may be used as the second link element in place of the rod of a predetermined length that is used in this embodiment. In such a case, the second link element does not function as a supporting means, but the first link element does. However, the arm mounts can be moved in almost the same path as in this embodiment between the first and second use positions. When the arm mounts are moved, the path may change slightly. That is, the second link element has a predetermined length at the first and second use positions, while the distance between the ends of the second link element, at which the first and second attachment holes are provided, may vary slightly due to elastic deformation of a spring when the arm mounts move between the first and second use positions. Thus, even if it is slightly difficult to move the arm mounts to the second use position due to the physical build or position of the person in the chair, he or she can move the arm mounts slightly away from him or herself during movement from the first to the second use position, and can return the arm mounts to their original positions at the first and second use positions. Thus, the arm mounts can be used more conveniently. Of course, an elastic body made of rubber or the like may be substituted for the spring.

In addition to designing the arm mounts so that they can move with respect to the arm support, providing a controlling means between the arm support and chair body that is used to rotate the arm support in a substantially regular path together with the arm mounts allows the arm mounts to be appropriately used as armrests. In such a case, it is preferable that the arm mounts be curved or bent to prevent the arm support from interfering with the person in the chair during movement.

The present invention is not limited to the above embodiment, but various modifications can be made without departing from the scope and spirit of the present invention. For example, rail, gear, and belt mechanisms designed to move the arm mounts in a regular path can be applied to the present invention.

POSSIBLE APPLICATIONS IN INDUSTRY

As mentioned above, the chair in accordance with the present invention is ideally used in offices or the like as a chair with armrests which can move according to a position of a person in a chair, such as a working position when operating a keyboard on the desk and a comfortable position when reclining against the back of the chair.

What is claimed is:

1. A chair comprising a chair body and armrests installed on the sides of the chair body, wherein the armrests include arm supports and arm mounts, with the arm supports being attached to the sides of the chair body and the arm mounts being supported by the arm supports, wherein a controlling means is provided between the chair body and the armrest for controlling at least the arm mounts so that they can move in a substantially regular path around a person in the chair, between a first use position, wherein a length direction of the arm mounts is nearly in a longitudinal direction of the chair body; and a second use position wherein the length direction of the arm mounts is nearly in a lateral direction of the chair body, wherein a supporting means is provided between the arm supports so that the arm mounts can be moved between the first and second use positions by the supporting means, and the controlling means is used to control movement of the arm mounts by the supporting means, wherein said chair further comprises a link mechanism which serves as the supporting means and controlling means, and the arm mounts are connected through the link mechanism to the arm supports.

2. The chair according to claim 1, wherein the controlling means is provided between the chair body and arm supports so as to rotate the arm supports together with the arm mounts around a person in the chair.

3. The chair according to claim 2, wherein the arm supports are either curved or bent to not interfere with a person in the chair when he or she moves between the first and second use positions.

4. The chair according to claim 1, wherein an armrest is disposed on each of the sides of the chair body, and the ends of the arm mounts contact against each other when the pair of armrests is placed in the second use position.

5. The chair according to claim 1, wherein the link mechanism consists of first and second link elements that are rotatably attached to the connections of the arm supports and the arm mounts, at least the first link element is used as the supporting means, and the first and second link elements constitute the controlling means.

6. The chair according to claim 5, further comprising attachment holes in the first and second link elements wherein straight lines connecting the attachment holes form a tetragon shape but do not form a parallelogram.

7. The chair according to claim 6, wherein the first and second link elements are made to interfere with each other either at or near the first and second use positions, to limit the range of movement of the first and second link elements.

8. The chair according to claim 6, wherein the second link element supports the arm mounts together with the first link element, and the link mechanism is used to uniquely determine the path of the arm mounts.

9. The chair according to claim 6, wherein the second link element consists of an elastic body, and the distance between the two attachment holes in the second link element is changed by deforming the elastic body when the arm mounts move from the first use position to the second use position.

10. The chair according to claim 5, wherein the first and second link elements interfere with each other either at or near the first and second use positions, to limit the range of movement of the first and second link elements.

11. The chair according to claim 10, wherein the second link element supports the arm mounts together with the first link element, and the link mechanism is used to uniquely determine the path of the arm mounts.

12. The chair according to claim 10, wherein the second link element consists of an elastic body, and the distance between the two attachment holes in the second link element is changed by deforming the elastic body when the arm mounts move from the first use position to the second use position.

13. The chair according to claim 5, wherein the second link element supports the arm mounts together with the first link element, and the link mechanism is used to uniquely determine the path of the arm mounts.

14. A chair comprising a chair body and armrests installed on the sides of the chair body, wherein the armrests include arm supports and arm mounts, with the arm supports being attached to the sides of the chair body and the arm mounts being supported by the arm supports, wherein a controlling means is provided between the chair body and the armrest for controlling at least the arm mounts so that they can move in a substantially regular path around a person in the chair, between a first use position, wherein a length direction of the arm mounts is nearly in a longitudinal direction of the chair body; and a second use position wherein the length direction of the arm mounts is nearly in a lateral direction of the chair body, wherein a supporting means is provided between the arm supports so that the arm mounts can be moved between the first and second use positions by the supporting means, and the controlling means is used to control movement of the arm mounts by the supporting means, wherein said chair further comprises a link mechanism which serves as the supporting means and controlling means, and the arm mounts are connected through the link mechanism to the arm supports, wherein the link mechanism consists of first and second link elements that are rotatably attached to the connections of the arm supports and the arm mounts, at least the first link element is used as the supporting means, and the first and second link elements constitute the controlling means, wherein a tetragon shape formed by straight lines connecting the attachment holes in the first and second link elements wherein the tetragon shape is not a parallelogram, wherein the first link element comprises a first hole for attachment to the arm support and a second hole for attachment to the arm mount and the second link element comprises a third hole for attachment to the arm support and a fourth hole for attachment to the arm mount;

wherein the first link element rotates around the second hole for attachment from an obliquely rear outside position to an inside position, with the first hole for attachment at the center of rotation, the second link element rotates around the fourth hole for attachment from an obliquely rear outside position to an obliquely front outside position, with the third hole for attachment at the center of rotation; and a straight line connecting the second hole and the fourth hole rotates between the first and second use positions, thereby from the position at which the line is nearly in the longitudinal direction of the arm mount to the position at which the line is nearly in the lateral direction of the arm mount.

15. The chair according to claim 14, wherein the first and second link elements are made to interfere with each other either at or near the first and second use positions, to limit the range of movement of the first and second link elements.

16. The chair according to claim 14, wherein the second link element supports the arm mounts together with the first link element, and the link mechanism is used to uniquely determine the path of the arm mounts.

17. The chair according to claim 14, wherein the second link element consists of an elastic body, and the distance between the two attachment holes in the second link element is changed by deforming the elastic body when the arm mounts move from the first use position to the second use position.

18. A chair comprising a chair body and armrests installed on the sides of the chair body, wherein the armrests include arm supports and arm mounts, with the arm supports being attached to the sides of the chair body and the arm mounts being supported by the arm supports, wherein a controlling means is provided between the chair body and the armrest for controlling at least the arm mounts so that they can move in a substantially regular path around a person in the chair, between a first use position, wherein a length direction of the arm mounts is nearly in a longitudinal direction of the chair body; and a second use position wherein the length direction of the arm mounts is nearly in a lateral direction of the chair body, wherein a supporting means is provided between the arm supports so that the arm mounts can be moved between the first and second use positions by the supporting means, and the controlling means is used to control movement of the arm mounts by the supporting means, wherein said chair further comprises a link mechanism which serves as the supporting means and controlling means, and the arm mounts are connected through the link mechanism to the arm supports, wherein the link mechanism consists of first and second link elements that are rotatably attached to the connections of the arm supports and the arm mounts, at least the first link element is used as the supporting means, and the first and second link elements constitute the controlling means, wherein the second link element consists of an elastic body, and the distance between attachment holes in the second link element is changed by deforming the elastic body when the arm mounts move from the first use position to the second use position.

* * * * *